US010913625B2

(12) United States Patent
Mimoto et al.

(10) Patent No.: US 10,913,625 B2
(45) Date of Patent: Feb. 9, 2021

(54) SHEET CONVEYING APPARATUS

(71) Applicant: Brother Kogyo Kabushiki Kaisha, Nagoya (JP)

(72) Inventors: Masao Mimoto, Nagoya (JP); Shohei Ichikawa, Kasugai (JP); Kengo Noda, Inazawa (JP); Tsuyoshi Ito, Nagoya (JP); Yoshimitsu Taniguchi, Tajimi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/261,686

(22) Filed: Jan. 30, 2019

(65) Prior Publication Data

US 2019/0233231 A1 Aug. 1, 2019

(30) Foreign Application Priority Data

Jan. 31, 2018 (JP) ..... 2018-014577

(51) Int. Cl.
*B65H 5/06* (2006.01)
*B65H 29/12* (2006.01)
*B65H 29/70* (2006.01)

(52) U.S. Cl.
CPC ..... *B65H 5/062* (2013.01); *B65H 29/125* (2013.01); *B65H 29/70* (2013.01);
(Continued)

(58) Field of Classification Search
CPC ..... B65H 5/062; B65H 9/16; B65H 9/166; B65H 27/00; B65H 29/125; B65H 2301/3114; B65H 2301/3412; B65H 2402/54; B65H 2402/541; B65H 2402/542; B65H 2402/543; B65H 2404/12; B65H 2404/134; B65H 2404/1341; B65H 2404/1345; B65H 2404/1431;
(Continued)

(56) References Cited

U.S. PATENT DOCUMENTS 5,534,894 A * 7/1996 Hirano ..... B41J 2/16523 346/134
5,606,357 A * 2/1997 Bekki ..... B41J 13/076 271/274

(Continued)

FOREIGN PATENT DOCUMENTS

JP 2002-128352 A 5/2002
JP 2016-160025 A 9/2016

OTHER PUBLICATIONS

Dec. 25, 2020—JP Notice of Reasons for Refusal—App 2018-14577, Eng Tran.

*Primary Examiner* — Prasad V Gokhale
(74) *Attorney, Agent, or Firm* — Banner & Witcoff, Ltd.

(57) ABSTRACT

A sheet conveying apparatus includes: a conveying roller configured to convey a sheet in a conveying direction; driven rollers arranged with intervals in a width direction intersecting with the conveying direction, the driven rollers being opposed to the conveying roller in a direction perpendicular to the conveying direction and the width direction; and coil springs provided corresponding to the driven rollers respectively and serving as rotating shafts for rotatably supporting the driven rollers, wherein the coil springs include a right-handed twining coil spring and a left-handed twining coil spring.

13 Claims, 10 Drawing Sheets

(52) U.S. Cl.
CPC ..... *B65H 2301/5122* (2013.01); *B65H 2402/542* (2013.01); *B65H 2404/1115* (2013.01); *B65H 2404/12* (2013.01); *B65H 2404/1341* (2013.01); *B65H 2404/1345* (2013.01); *B65H 2404/1416* (2013.01); *B65H 2404/1431* (2013.01); *B65H 2404/54* (2013.01); *B65H 2404/611* (2013.01); *B65H 2801/06* (2013.01); *B65H 2801/12* (2013.01); *B65H 2801/15* (2013.01)

(58) Field of Classification Search
CPC ..... B65H 2404/54; B65H 2404/611; B65H 2801/12; B65H 29/70
See application file for complete search history.

(56) References Cited

U.S. PATENT DOCUMENTS

| | | | | | |
|---|---|---|---|---|---|
| 6,016,900 | A * | 1/2000 | Longrod | B65G 39/12 | 193/35 F |
| 6,299,367 | B1 * | 10/2001 | Kawakami | B41J 13/02 | 267/180 |
| 7,264,239 | B2 * | 9/2007 | Kawai | B41J 13/02 | 271/188 |
| 2004/0245715 | A1 * | 12/2004 | Zheng | B65H 5/062 | 271/274 |
| 2006/0163803 | A1 * | 7/2006 | Izuchi | B65H 5/062 | 271/272 |
| 2013/0321546 | A1 * | 12/2013 | Lo | B65H 5/062 | 347/104 |
| 2015/0197081 | A1 * | 7/2015 | Kobayashi | B41J 13/106 | 101/408 |

* cited by examiner

SHEET CONVEYING APPARATUS

CROSS REFERENCE TO RELATED APPLICATION

The present application claims priority from Japanese Patent Application No. 2018-014577 filed on Jan. 31, 2018, the disclosure of which is incorporated herein by reference in its entirety.

BACKGROUND

Field of the Invention

The present invention relates to a sheet conveying apparatus. In particular, the present invention relates to a structure which is useful to reduce a sheet skew caused by inclination of driven rollers with respect to a conveying direction of a sheet when the sheet is conveyed by a conveying roller and the driven rollers.

Description of the Related Art

As described in Japanese Patent Application Laid-open No. 2016-160025, a conventional ink-jet type printer generally adopts a structure which is provided with a paper discharge roller in order to convey a sheet in a subsidiary scanning direction. Further, driven rollers are provided at positions opposed to the paper discharge roller in order to convey the sheet in cooperation with the paper discharge roller. The driven rollers are aligned in a main scanning direction, on a downstream side of a recording unit in the subsidiary scanning direction (i.e., in the conveying direction of the sheet).

Each of the driven rollers is supported rotatably by a coil spring which serves as a rotation shaft. The driven roller is urged toward the paper discharge roller by elastic force of the coil spring. Accordingly, nip pressure to nip the sheet between the paper discharge roller and the driven rollers is generated.

SUMMARY

The driven roller, which is rotatably supported by the coil spring, is inclined with respect to the subsidiary scanning direction, by the force which is received from the sheet when the sheet is conveyed. In other words, the driven roller is inclined so that the position in the main scanning direction of the upstream end in the subsidiary scanning direction is different from the position in the main scanning direction of the downstream end. The sheet, which is conveyed by the paper discharge roller and the driven rollers, is conveyed while being skewed in the direction in which the driven roller is inclined. Therefore, for example, when an image is recorded on a printing surface of the sheet while conveying the sheet by the paper discharge roller and the driven rollers, it is feared that the landing position of the ink may be deviated from a desired position, and the image recording result may be disturbed.

The driven roller and the coil spring are supported by a driven roller holder. The driven roller holder has a pair of regulating surfaces which regulate the inclination of the driven roller. The pair of regulating surfaces are provided mutually opposing to each other so that the driven roller is interposed therebetween. Then, the pair of regulating surfaces regulate the inclination of the driven roller so that the driven roller is rotated while maintaining the attitude parallel to the subsidiary scanning direction. However, in order to smoothly rotate the driven roller, it is necessary to provide any clearance between the driven roller and the regulating surface. It is difficult to completely regulate the inclination of the driven roller.

The present inventors have investigated the factor of the inclination of the driven roller. As a result, it has been found out that the inclination of the driven roller is affected by the twining direction of the coil spring for supporting the driven roller. In particular, it has been found out that the following tendency appears. That is, the driven roller which is supported by the coil spring having the right-handed or clockwise twining direction (subjected to the clockwise twining from the starting point at which the twining is started) and the driven roller which is supported by the coil spring having the left-handed or counterclockwise twining direction (subjected to the counterclockwise twining from the starting point at which the twining is started) tend to be inclined in mutually opposite directions.

The present teaching has been made based on the novel finding brought about by the present inventors as described above, an object of which is to provide a sheet conveying apparatus which makes it possible to suppress driven rollers from being inclined in an identical direction and reduce the sheet skew by supporting the driven rollers by using coil springs having different twining directions.

According to an aspect of the present teaching, there is provided a sheet conveying apparatus including: a conveying roller configured to convey a sheet in a conveying direction; driven rollers arranged with intervals in a width direction intersecting with the conveying direction, the driven rollers being opposed to the conveying roller in a direction perpendicular to the conveying direction and the width direction; and coil springs provided corresponding to the driven rollers respectively and serving as rotating shafts for rotatably supporting the driven rollers, wherein the coil springs include a right-handed twining coil spring and a left-handed twining coil spring.

According to this configuration, the coil springs, which rotatably support the driven rollers, include the right-handed (clockwise) twining coil spring and the left-handed (counterclockwise) twining coil spring. Accordingly, it is possible to suppress the driven rollers from being inclined in an identical direction, and it is possible to suppress the sheet from being skewed in the direction in which the driven rollers are inclined.

According to the present teaching, it is possible to suppress the driven rollers from being inclined in an identical direction and reduce the sheet skew by supporting the driven rollers by using the coil springs having the different twining directions.

DESCRIPTION OF THE EMBODIMENTS

An explanation will be made below about an embodiment of the present teaching by appropriately making reference to the drawings. Note that the embodiment explained below is merely an example of the present teaching. It goes without saying that the embodiment of the present teaching can be appropriately changed within a range without changing the gist or essential characteristics of the present teaching. In the following explanation, the up-down direction 7, the front-rear direction 8, and the left-right direction 9 (hereinafter referred to as "width direction 9") are defined based on the state depicted in FIG. 1 where the multifunction peripheral 10 is usably installed.

<Overall Construction of Multifunction Peripheral 10>

Figure 1:
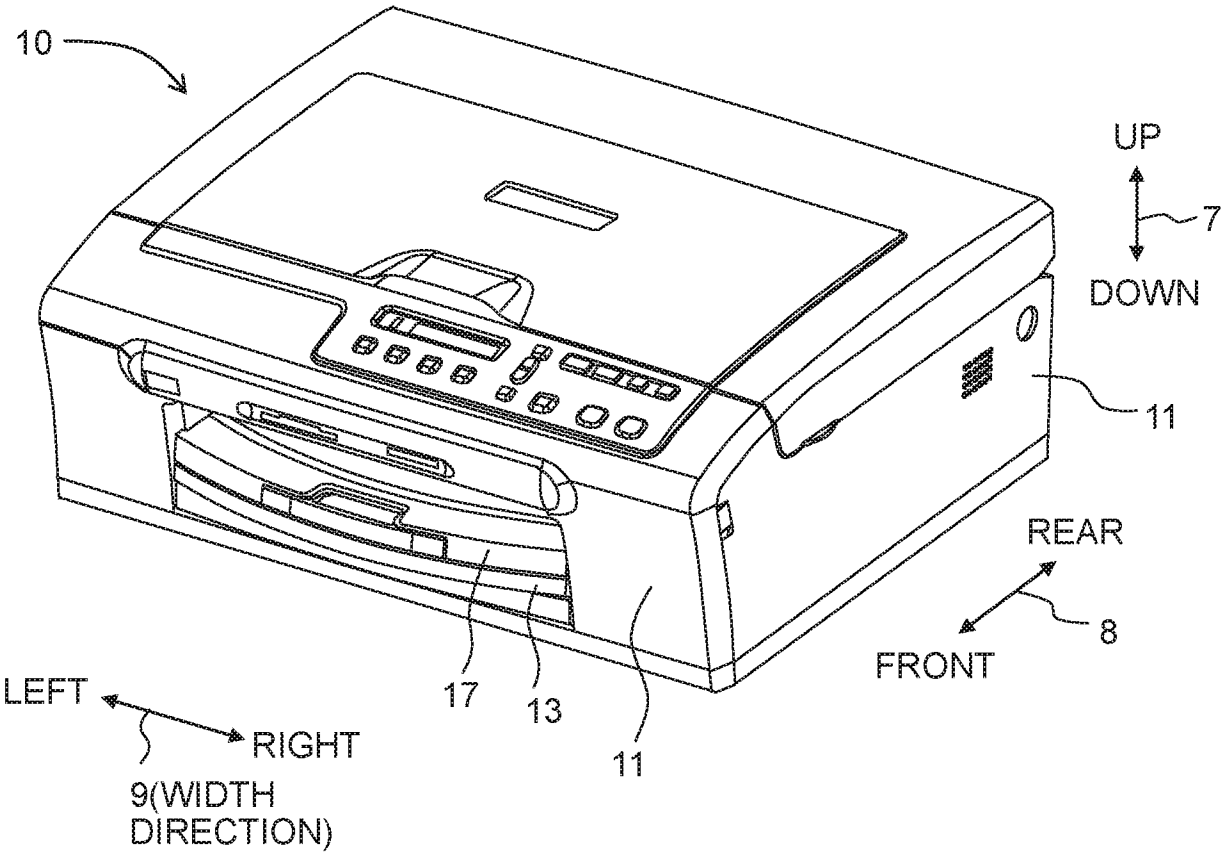
FIG. 1 depicts a perspective view illustrating a multifunction peripheral as an exemplary embodiment of the present teaching.

The multifunction peripheral 10 depicted in FIG. 1 (example of the "ink-jet recording apparatus") has various functions including, for example, a printer function, a facsimile function, and a copy function. The multifunction peripheral 10 has a main apparatus body 11 which is constructed to have a rectangular parallelepiped shape, and a feed tray 13 which is removable with respect to a lower portion of the main apparatus body 11. As depicted in FIG. 1, the feed tray 13, which is installed to the main apparatus body 11, is drawn out frontwardly with respect to the main apparatus body 11, and thus the feed tray 13 is removed from the main apparatus body 11.

Figure 2:
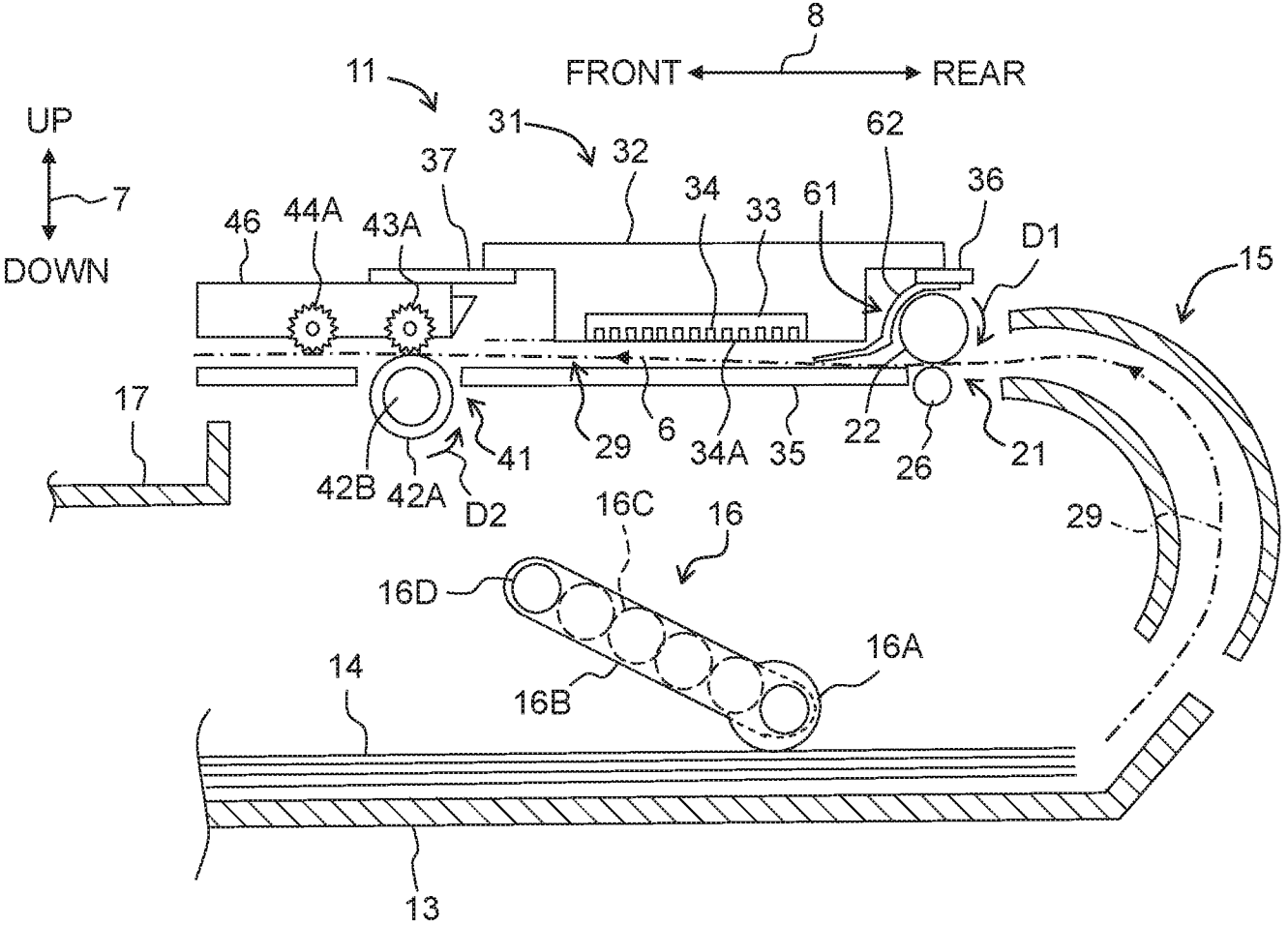
FIG. 2 depicts a schematic view illustrating a structure of the multifunction peripheral.

As depicted in FIG. 2, a recording unit 31, which records an image on a recording medium, is provided at an upper portion of the main apparatus body 11. The feed tray 13, which is installed to the main apparatus body 11, is positioned under the recording unit 31. The feed tray 13 can accommodate sheets as the recording medium in a state of being stacked in the up-down direction. In the embodiment of the present teaching, the recording paper 14, which is the regular paper having the A4 size, is accommodated in the feed tray 13 in a state in which the longitudinal direction extends along the front-rear direction 8. Note that the size or the like of the recording paper 14 accommodated in the feed tray 13 is referred to by way of example, and it is also allowable to use any sheet other than the regular paper having any other size.

A feed unit 16 which conveys rearwardly one sheet of the recording paper 14 disposed at the uppermost position of those accommodated in the feed tray 13, and a feed guide member 15 which upwardly guides the recording paper 14 conveyed rearwardly from the feed tray 13 are provided in the main apparatus body 11. The feed guide member 15 is arranged at a position disposed closely to the rear surface in the main apparatus body 11.

As depicted in FIG. 2, the feed unit 16 has a feed roller 16A which extends in the width direction 9, and a support arm 16B which supports the feed roller 16A movably in the up-down direction 7. The support arm 16B is rotatably supported by a support shaft 16D which extends in the width direction 9, and the feed roller 16A is rotatably supported at a forward end portion of the support arm 16B. When the support arm 16B is rotated in the up-down direction 7 about the center of the support shaft 16D, the feed roller 16A is moved to a position at which the feed roller 16A abuts against the recording paper 14 disposed at the uppermost position in the feed tray 13 and a position at which the feed roller 16A is separated upwardly from the recording paper 14. The feed roller 16A is rotated by the motive power of an unillustrated motor transmitted via a power transmission mechanism 16C.

When the feed roller 16A is rotated in a state in which the feed roller 16A abuts against the recording paper 14 disposed at the uppermost position in the feed tray 13, the recording paper 14 is fed rearwardly. The recording paper 14, which is fed from the feed tray 13, is conveyed to a lower end portion of the feed guide member 15.

A conveying passage 29, through which the recording paper 14 passes, is provided in the feed guide member 15. The feed guide member 15 is formed to have a circular arc shape protruding toward the rear surface of the main apparatus body 11. The recording paper 14, which is guided by the feed guide member 15, is conveyed frontwardly from the upper end portion of the feed guide member 15.

Note that the recording paper 14 accommodated in the feed tray 13 is conveyed in a state in which the central portion in the width direction 9 moves along the central portion in the width direction 9 of the conveying passage 29 (center basis). Further, the multifunction peripheral 10 can also feed, into the conveying passage 29 on the center basis, any recording paper 14 having any size smaller than the recording paper 14 having the A4 size, for example, the postcard (having a rigidity higher than that of the regular paper), without being limited to the recording paper 14 having the A4 size. Note that the postcard is merely an example of the sheet having the small size. It is also allowable to use any sheet or the like having the large (L) size.

A conveying roller pair 21, which conveys the recording paper 14 having passed through the upper end portion of the feed guide member 15 to a position under the recording unit 31, is provided in front of the upper end portion of the feed guide member 15. A platen 35, which supports the recording paper 14 under the recording unit 31, is provided in front of the conveying roller pair 21, i.e., downstream in the conveying direction of the recording paper 14 conveyed by the conveying roller pair 21 (hereinafter referred to as "conveying direction 6" (see FIG. 2)). An upstream wavy shape applying mechanism 61 and a downstream wavy shape applying mechanism 41, which apply the wavy shape in the width direction 9 to the recording paper 14, are provided respectively at the upstream and the downstream in the conveying direction 6 from a recording head 33 provided at a lower portion of the recording unit 31.

The conveying roller pair 21 has one conveying roller 22 which abuts against the upper surface of the recording paper 14 having passed through the feed guide member 15, and pinch rollers 26 which abut against the lower surface of the recording paper 14. The recording paper 14, which has passed through the feed guide member 15, is interposed (nipped) by the conveying roller 22 and the pinch rollers 26, and the recording paper 14 is conveyed to the conveying passage 29 disposed between the platen 35 and the recording unit 31. The conveying passage 29 arrives at a paper discharge tray 17 via the downstream wavy shape applying mechanism 41.

The recording unit 31, which is provided over the platen 35, is supported by a first guide frame 36 and a second guide frame 37 which extend in the width direction 9 perpendicular to the conveying direction 6 respectively. The first guide frame 36 and the second guide frame 37 are supported in parallel to one another in a state in which a constant predetermined interval is provided in the conveying direction 6.

The recording unit 31 has a carriage 32 which is provided slidably in a bridged manner between the first guide frame 36 and the second guide frame 37. The recording head 33 is provided at a lower portion of the carriage 32.

The recording head 33 is provided with nozzles 34 which discharge inks downwardly. The inks are supplied from ink cartridges (not depicted) to the respective nozzles 34. The nozzles 34 are arranged in an array form in the conveying direction 6. The nozzles 34 are open on a nozzle surface 34A which is the lower surface of the recording head 33. The nozzle surface 34A is a flat surface extending in the conveying direction 6 and the width direction 9. Note that in the embodiment of the present teaching, the nozzle surface 34A is in a horizontal state.

The platen 35, which is provided under the recording unit 31, supports the recording paper 14 conveyed by the conveying roller pair 21. When the recording paper 14 is conveyed by the conveying roller pair 21 to a predetermined position on the platen 35, the conveyance of the recording paper 14 is stopped.

If the recording paper 14 is stopped on the platen 35, the recording process is executed in the recording unit 31 such that the inks are selectively discharged from the nozzles 34 of the recording head 33 during the period in which the carriage 32 is allowed to slide in the width direction 9 perpendicular to the conveying direction 6. After that, the conveying process in which the recording paper 14 on the platen 35 is conveyed by a predetermined distance by the conveying roller pair 21 and the recording process described above are repeatedly executed, and thus the image is record on the entire recording paper 14.

<Downstream Wavy Shape Applying Mechanism 41>

The downstream wavy shape applying mechanism 41, which is provided in the conveying direction 6 with respect to the recording head 33, conveys the recording paper 14 supported on the platen 35 in the conveying direction 6, and the downstream wavy shape applying mechanism 41 applies the wavy shape along the width direction 9 to the recording paper 14 disposed on the platen 35.

The downstream wavy shape applying mechanism 41 has discharge rollers 42A, and first spurs 43A and second spurs 44A. The discharge rollers 42A are arranged while being separated from each other in the width direction 9, and the discharge rollers 42A abut against the lower surface of the recording paper 14 for which the image has been recorded by the recording unit 31. Each of the first spurs 43A is arranged over each of the discharge rollers 42A, and each of the first spurs 43A abuts against the upper surface of the recording paper 14 for which the image has been recorded by the recording unit 31. Each of the first spurs 43A is supported by a spur support member 46. One discharge roller shaft 42B is inserted into shaft center portions of the discharge rollers 42A.

The recording paper 14 is interposed at the nip position NP2 (see FIG. 5) by the discharge rollers 42A and the first spurs 43A. Thus, the recording paper 14 is in a wavy state in the width direction 9, and the recording paper 14 is conveyed to the downstream in the conveying direction 6. The respective second spurs 44A are supported by shaft members 44B. The second spurs 44A abut against the upper surface of the recording paper 14 conveyed by the discharge rollers 42A and the first spurs 43A. After that, the recording paper 14 is discharged onto the paper discharge tray 17. Each of the second spurs 44A has two disk-shaped spur portions 44C which are provided while being separated by an interval in the width direction 9.

<Upstream Wavy Shape Applying Mechanism 61>

Figure 3:
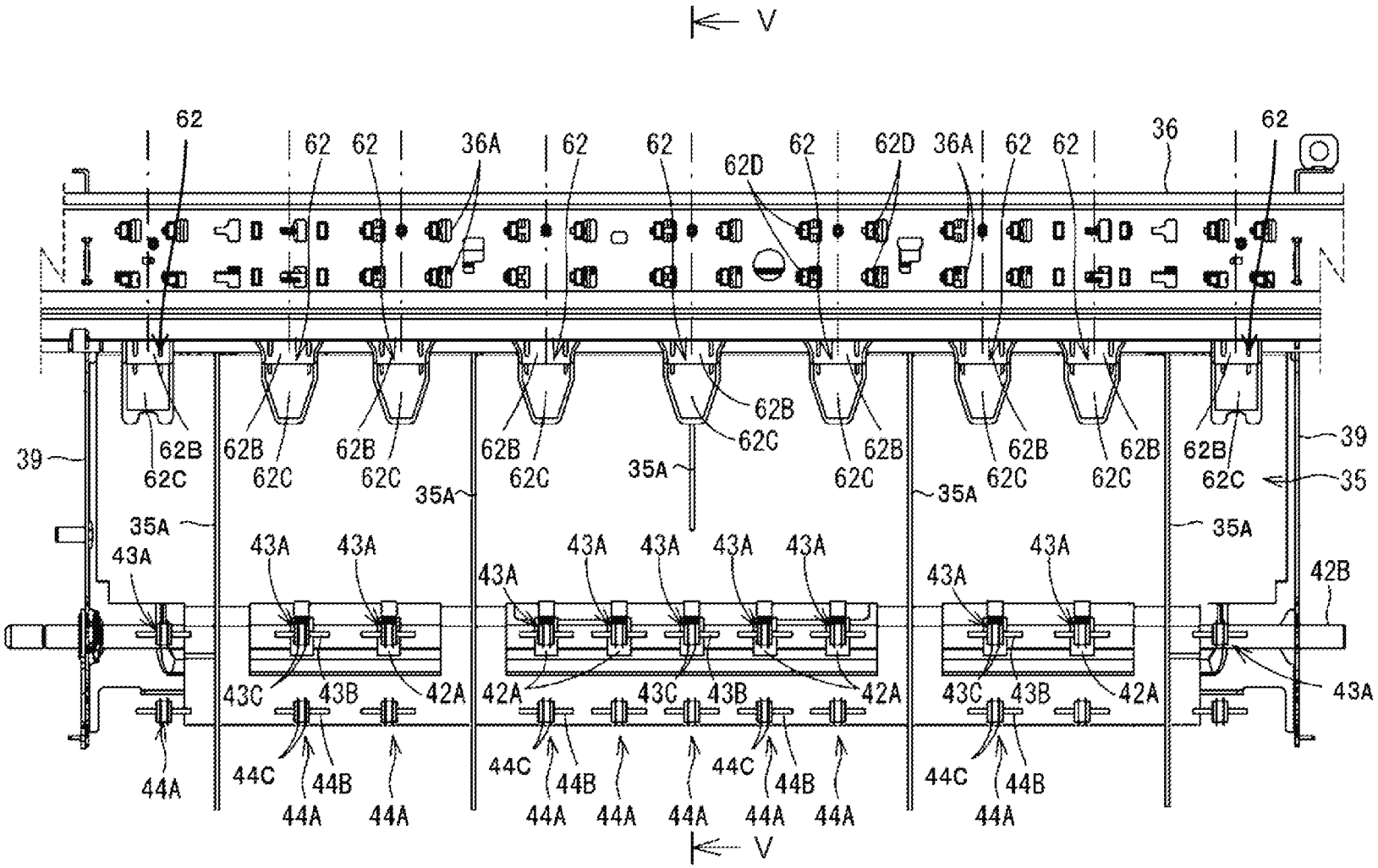
FIG. 3 depicts a plan view illustrating a first guide rail and a platen.
Figure 4:
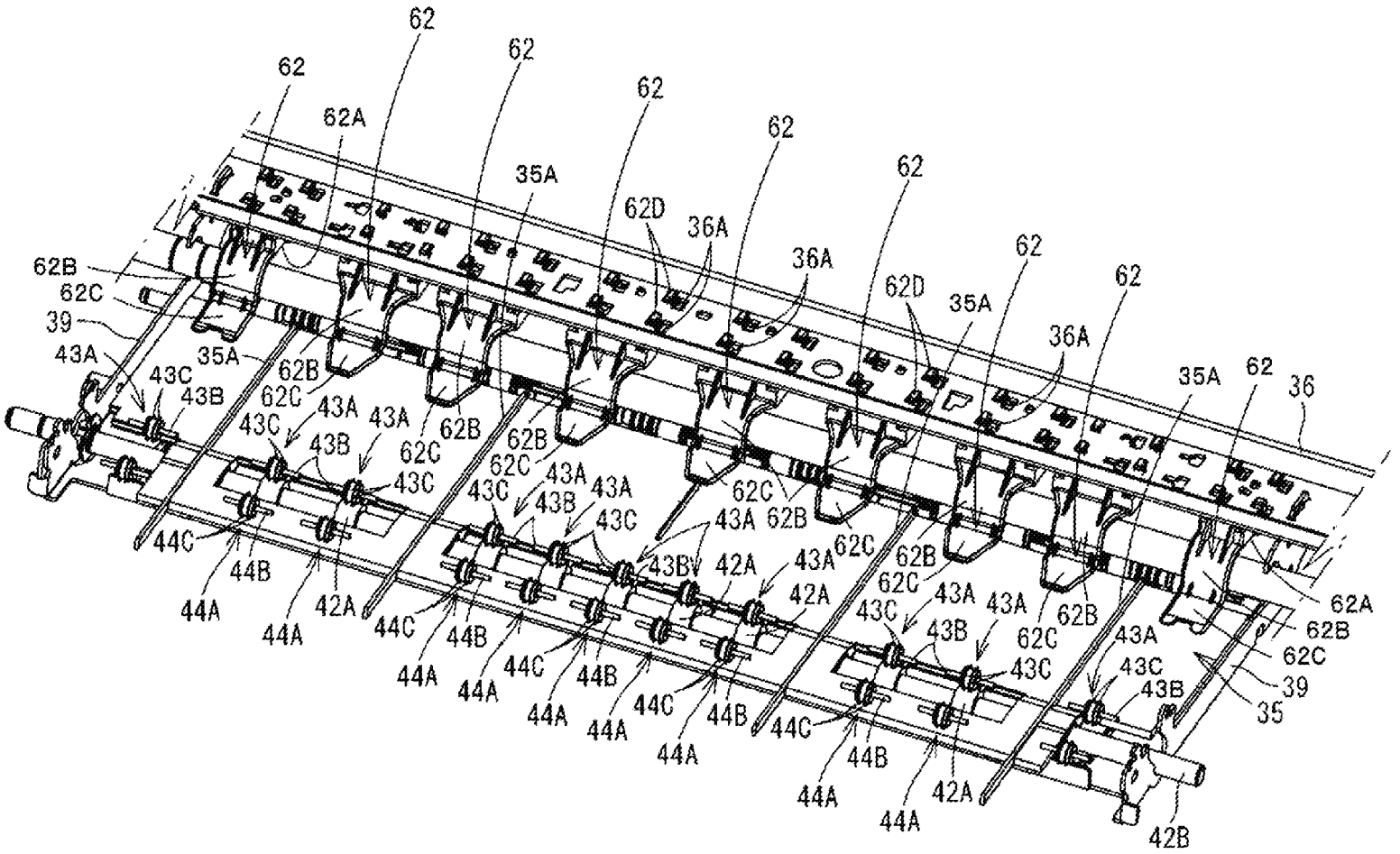
FIG. 4 depicts a perspective view as viewed from the downstream in the conveying direction illustrating those depicted in FIG. 3.
Figure 5:
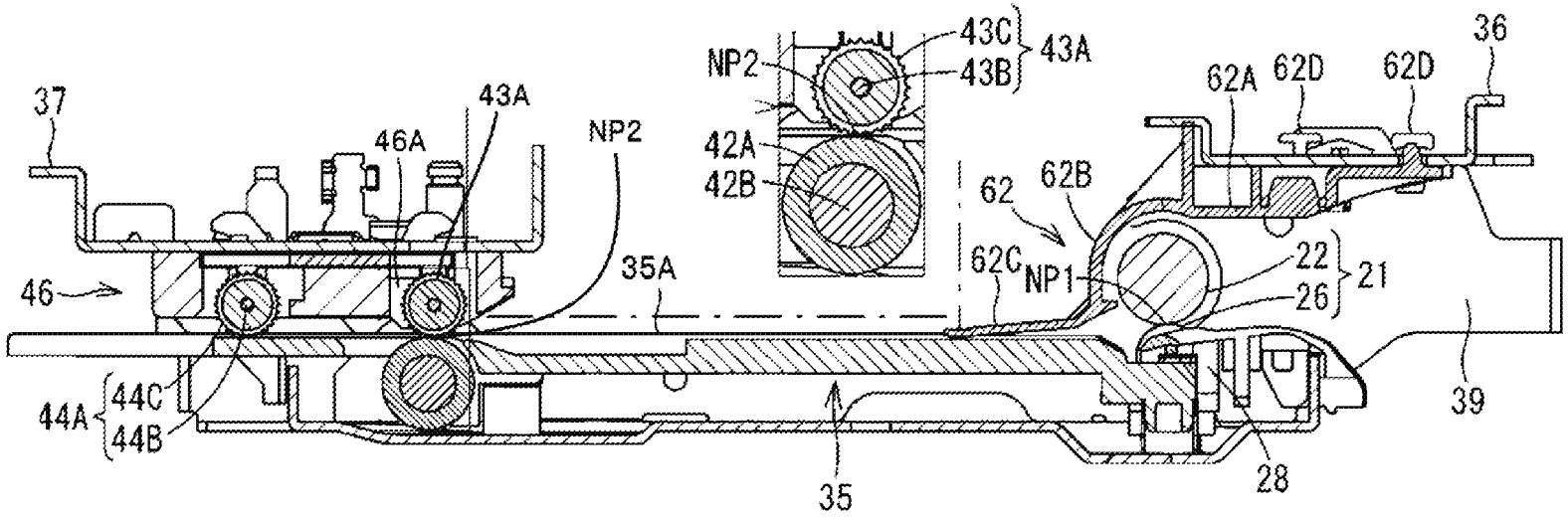
FIG. 5 depicts a sectional view taken along a line V-V depicted in FIG. 3.

As depicted in FIGS. 3 and 4, the upstream wavy shape applying mechanism 61 has upstream abutment members 62 which are attached to the lower surface of the first guide frame 36. Each of the upstream abutment members 62 is formed to have an identical shape. As depicted in FIG. 5, each of the upstream abutment members 62 has a base portion 62A which is attached to the lower surface of the first guide frame 36, a connecting portion 62B which is in a state of vertically hanging from the base portion 62A, and an abutment portion 62C which is provided at a lower end portion of the connecting portion 62B. The abutment portion 62C is movable in the up-down direction 7 perpendicular to the conveying direction 6. The upstream abutment member 62 is integrally formed of a synthetic resin (for example, polyacetal (POM)).

The base portions 62A are positioned under the first guide frame 36. Fastening portions 62D are provided, which are fastened to the first guide frame 36. Each of the fastening portions 62D protrudes upwardly from the base portion 62A. The first guide frame 36 is provided with openings 36A into which the fastening portions 62D are inserted (see FIGS. 3 and 4).

As depicted in FIGS. 3 and 4, the platen 35 is provided with ribs 35A which protrude toward the conveying passage 29 disposed upwardly, from the upper surface of the platen 35 and which support the recording paper 14 at downward positions. The ribs 35A have the same or equivalent structure. Each of the ribs 35A is provided to extend in the sheet conveying direction 6.

The abutment portions 62C of the upstream abutment members 62 are constructed so that the abutment portions 62C are movable in the up-down direction 7. When the recording paper 14 is conveyed to the space between the platen 35 and the upstream abutment member 62, the abutment portion 62C is moved upwardly by an amount corresponding to the thickness of the recording paper 14. The upper ends of the ribs 35A are positioned upwardly as compared with the positions of the lower ends of the abutment portions 62C moved upwardly by the amount corresponding to the thickness of the recording paper 14 (position of abutment against the recording paper 14). The abutment portions 62C abut at the upward positions against the recording paper 14 supported by the platen 35. Further, the recording paper 14 is supported by the ribs 35A at the downward positions. As a result, the wavy shape is formed in the width direction 9 on the recording paper 14.

<Conveying Roller Pair 21>

Both end portions in the width direction 9 of the conveying roller 22 are supported by subframes 39 which support both end portions in the width direction 9 of the first guide frame 36. Note that both end portions in the width direction 9 of the second guide frame 37 are also supported by the subframes 39. The rotation of the unillustrated motor is transmitted to the conveying roller 22, and thus the conveying roller 22 is rotated in the direction indicated by the arrow D1 in FIG. 2.

As depicted in FIG. 5, the pinch rollers 26 are provided under the conveying roller 22. The pinch rollers 26 are supported by roller holders 28 in a state of being separated from each other by intervals in the width direction 9. The roller holder 28 is movable so that each of the pinch rollers 26 may be in the state in which each of the pinch rollers 26 makes contact with the conveying roller 22 and the state in which each of the pinch rollers 26 is separated from the conveying roller 22. Each of the pinch rollers 26, which makes contact with the conveying roller 22, is rotated while following the rotation of the conveying roller 22.

The position, at which the conveying roller 22 and each of the pinch rollers 25 make contact with each other, is the nip position NP1 at which the conveyed recording paper 14 is interposed. The recording paper 14, which is interposed at the nip position NP1 (see FIG. 5), is conveyed to the downstream in the conveying direction 6 in accordance with the rotations of the conveying roller 22 and the pinch rollers 26.

<Discharge Rollers 42A, First Spurs 43A>

Each of the discharge rollers 42A is formed of an elastic material such as rubber or the like to have a cylindrical shape. The discharge rollers 42A are fitted so that the discharge rollers 42A are coaxial with the discharge roller shaft 42B. The rotational force of the motor is transmitted to the discharge roller shaft 42B via an unillustrated transmission mechanism, and the discharge roller shaft 42B is rotated in the direction indicated by the arrow D2 in FIG. 2. Accordingly, all of the discharge rollers 42A are rotated in an integrated manner.

As depicted in FIG. 5, the first spurs 43A which are provided over the discharge rollers 42A and the second spurs 44A which are provided downstream in the conveying direction 6 from the first spurs 43A are supported by spur support members 46. As depicted in FIG. 5, the upstream end portion in the conveying direction 6 of the spur support member 46 is positioned over the discharge rollers 42A. As depicted in FIG. 4, each of the first spurs 43A is supported over each of the discharge rollers 42A. Each of the first spurs 43A is provided with two disk-shaped spur portions 43C which are separated from each other by an interval in the width direction 9. Protrusions and recesses are provided in the circumferential direction on the outer circumferential surface of each of the spur portions 43C. A shaft member 43B, which is a coil spring, is inserted in the width direction 9 into the shaft center portion of each of the first spurs 43A. A spur support portion 46A is provided in the conveying direction 6 (see FIG. 5) on both outer sides in the width direction 9 with respect to the spur portion 43C. The shaft member 43B is rotatably supported by the spur support portion 46A. The shaft member 43B has a shaft 43F, a first protrusion 43D, and a second protrusion 43E as described later on. Note that in the following explanation, the shaft member 43B is also referred to as "coil spring 43B".

As depicted in FIG. 5, each of the spur portions 43C of each of the first spurs 43A makes contact with each of the discharge rollers 43A positioned thereunder in a state in which the recording paper 14 is not conveyed, and each of the spur portions 43C is rotated while following the rotation of each of the discharge rollers 42A. The position, at which each of the spur portions 43C makes contact with the discharge roller 42A, is the nip position NP2 at which the conveyed recording paper 14 is interposed. The recording paper 14, which is interposed at the nip position NP2, is conveyed to the downstream in the conveying direction 6 in accordance with the rotation of the discharge rollers 42A and the spur portions 43C. The nip positions NP2, which are provided by the first spurs 43A and the discharge rollers 42A corresponding thereto, are the same as the positions in the width direction 9 at which the recording paper 14 abuts against the abutment portions 62C of the upstream abutment members 62 of the upstream wavy shape applying mechanism 61.

Figure 6A:
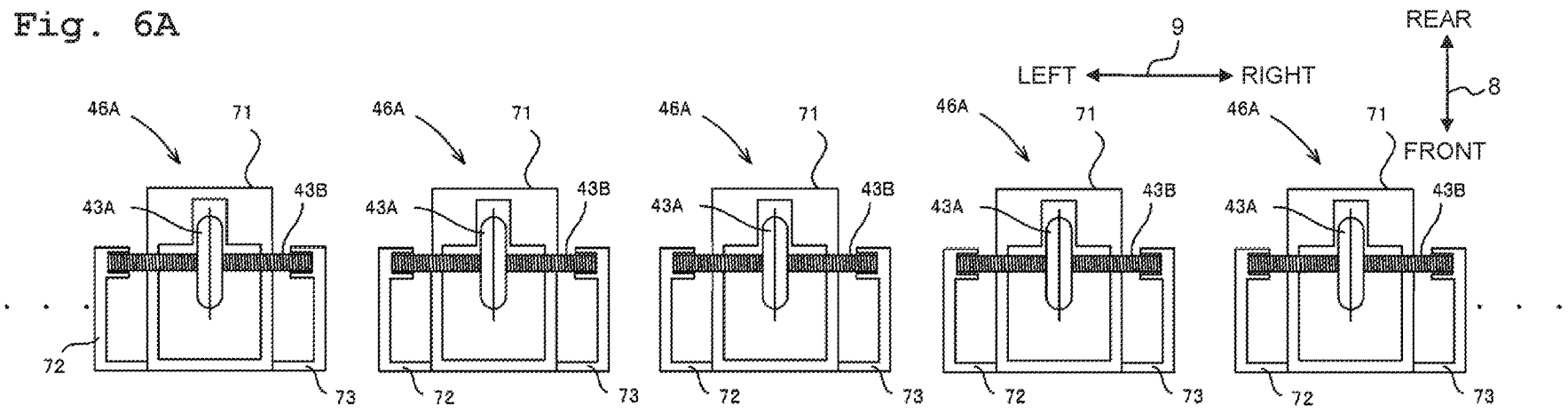
FIG. 6A depicts a plan view illustrating first spurs and spur support portions.

As depicted in FIG. 6A, each of the spur support portions 46A is composed of an abutment portion 71, a first regulating portion 72, and a second regulating portion 73. The abutment portion 71 abuts against the first spur 43A supported by the shaft member 43B to regulate the inclination of the first spur 43A. The first regulating portion 72 and the second regulating portion 73 are provided while being separated from each other by an interval in the width direction 9. The first regulating portion 72 and the second regulating portion 73 retain both end portions of the shaft member 43B in the width direction 9, and they regulate the shaft member 43B from being inclined. The abutment portion 71 is positioned under the shaft member 43B, and the abutment member 71 makes no contact with the shaft member 43B. The abutment member 71, the first regulating portion 72, and the second regulating portion 73 are integrally formed. Note that in the embodiment of the present teaching, the phrase "first spur 43A is inclined" indicates that the first spur 43A is inclined from the state parallel to the conveying direction 6 when the first spur 43A is viewed from above.

Figure 6B:
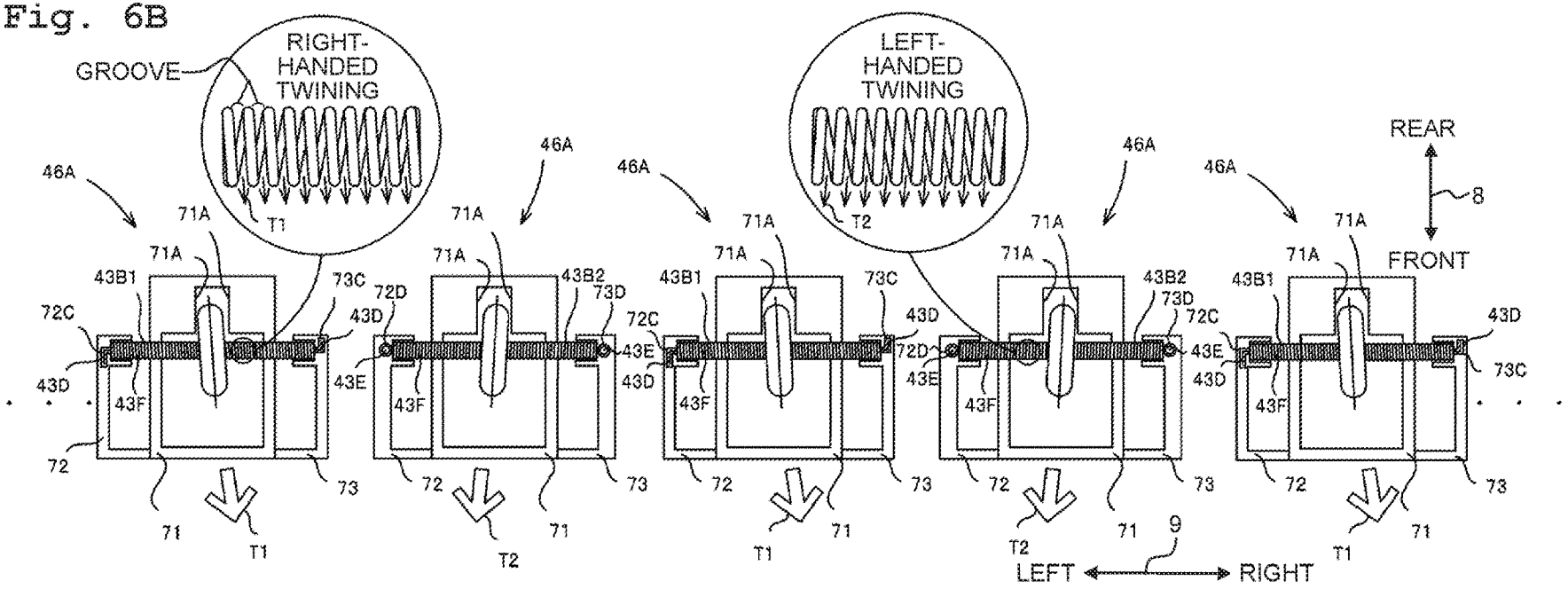
FIG. 6B depicts a plan view illustrating the first spurs and the spur support portions in a state where the first spurs are inclined.

As depicted in FIG. 6B, the abutment portion 71 has two abutment surfaces 71A which abut against the first spur 43A when the first spur 43A is inclined and which regulate the inclination of the first spur 43A. The two abutment surfaces 71A are formed mutually opposing each other so that the first spur 43A is interposed therebetween in the width direction 9.

As depicted in FIG. 6B, in the embodiment of the present teaching, a coil spring 43B1 which has the right-handed (clockwise) twining direction and a coil spring 43B2 which has the left-handed (counterclockwise) twining direction are used as the shaft members 43B. As described above, when each of the first spurs 43A abuts against the recording paper 14 conveyed in the conveying direction 6, each of the first spurs 43A is inclined with respect to the conveying direction 6 on account of the force received from the recording paper 14 (see FIG. 6B). If the first spurs 43A are inclined with respect to the conveying direction 6, it is feared that the recording paper 14, which is interposed by the discharge rollers 42A and the first spurs 43A and which is conveyed in the conveying direction 6, may be conveyed while being inclined or skewed in the direction in which the first spurs 43A are inclined.

The present inventors have investigated the factor of the inclination of the spur in order to suppress the skew or oblique movement of the recording paper. As a result, it has been found out that the spur has such a tendency that the direction of inclination differs depending on the twining direction of the coil spring for supporting the spur. In particular, as depicted in FIG. 6B, as for the coil spring, the direction, in which the groove of the coil spring extends, differs depending on whether the coil spring is produced by the right-handed twining (subjected to the clockwise twining from the starting point at which the twining is started) or the coil spring is produced by the left-handed twining (subjected to the counterclockwise twining from the starting point at which the twining is started). When the coil spring is inserted into the shaft hole of the spur, then the end portion of the shaft hole in the axial direction is fitted into the groove of the coil spring, and the attitude of the spur is decided. In other words, there is such a tendency that the spur is easily inclined in the direction in which the groove of the coil spring extends.

If the coil springs 43B, all of which have an identical twining direction, are used as the shaft members 43B for supporting the first spurs 43A, all of the first spurs 43A are easily inclined in an identical direction. In such a situation, it is feared that the recording paper 14, which is conveyed in the conveying direction 6, may be conveyed while skewing in the direction in which the first spurs 43A are inclined. If the recording paper 14 is conveyed while being skewed, the ink, which is discharged onto the recording paper 14 from the nozzle 34 of the recording head 33, has the landing position which is deviated from a desired position. As a result, it is feared that the image, which is recorded on the recording paper 14, may be disturbed.

In the embodiment of the present teaching, the coil springs 43B1 having the right-handed twining and the coil springs 43B2 having the left-handed twining are used as the shaft members 43B for supporting the first spurs 43A. Accordingly, the first spurs 43B can be suppressed from being inclined in the identical direction, and it is possible to suppress the skew of the recording paper 14 conveyed in the conveying direction 6 by the discharge rollers 42A and the first spurs 43A.

Further, in the embodiment of the present teaching, as depicted in FIG. 6B, the two coil springs 43B, which are included in the coil springs 43B and which adjoin in the width direction 9, have the mutually different twining directions. In other words, the coil springs 43B1 having the right-handed twining and the coil springs 43B2 having the left-handed twining are alternately arranged in the width direction 9. Accordingly, in relation to the two adjoining first spurs 43A, the force which intends to convey the recording paper 14 in the direction T1 (directed obliquely rightwardly in the frontward direction) and the force which intends to convey the recording paper 14 in the direction T2 (directed obliquely leftwardly in the frontward direction) are counteracted with each other. It is possible to more effectively suppress the skew of the recording paper 14.

Further, as depicted in FIG. 6B, the right-handed twining coil spring 43B1 has a pair of L-shaped first protrusions 43D which protrude in the width direction 9 from the both end portions in the width direction 9 of the shaft 43F. On the other hand, the left-handed twining coil spring 43B2 has a pair of circular second protrusions 43E which protrude in the width direction 9 from the both end portions in the width direction 9 of the shaft 43F. Each of the first protrusion 43D and the second protrusion 43E is integrated with the shaft 43F, and each of them is a part of the coil spring 43B. Further, the spur support portion 46A, which retains the right-handed twining coil spring 43B1, is formed with two L-shaped first engaging portions 72C, 73C which are engageable with the pair of first protrusions 43D. Further, the spur support portion 46A, which retains the left-handed twining coil spring 43B2, is formed with two circular second engaging portions 72D, 73D which are engageable with the pair of second protrusions 43E. The first engaging portions 72C, 73C are L-shaped grooves to which the first protrusions 43D are fitted. The second engaging portions 72D, 73D are circular grooves to which the second protrusions 43E are fitted. Accordingly, for example, when a product is assembled, even if the right-handed twining coil spring 43B1 is intended to be erroneously attached to the position at which the left-handed twining coil spring 34B2 is to be arranged, then the right-handed twining coil spring 43B1 cannot be attached, because the shapes of the first protrusions 43D and the second engaging portions 72D, 73D are different from each other. On the contrary, even if the left-handed twining coil spring 43B2 is intended to be erroneously attached to the position at which the right-handed twining coil spring 34B1 is to be arranged, the left-handed twining coil spring 43B2 cannot be attached, because the shapes of the second protrusions 43E and the first engaging portions 72C, 73C are different from each other.

As for the coil spring 43B, it is difficult to seemingly judge whether the coil spring 43B has the right-handed twining or the left-handed twining. Therefore, it is feared that the arrangement may be mistaken when the coil spring 43B is assembled. However, it is possible to suppress any assembling mistake in relation to the right-handed twining coil spring 43B1 and the left-handed twining coil spring 43B2 by changing the shapes between the right-handed twining coil spring 43B1 and the left-handed twining coil spring 43B2 and/or changing the shapes between the spur support portion 46A corresponding to the right-handed twining coil spring 43B1 and the spur support portion 46A corresponding to the left-handed twining coil spring 43B2 as in the embodiment of the present teaching. Note that the shapes of the first protrusions 43D, the second protrusions 43E, the first engaging portions 72C, 73C, and the second engaging portions 72D, 73D are not limited to the L-shaped shapes and the circular shapes. It is appropriate to provide different shapes so that the right-handed twining coil spring 43B1 is not assembled to the spur support portion 46A for retaining the left-handed twining coil spring 43B2, or the left-handed twining coil spring 43B2 is not assembled to the spur support portion 46A for retaining the right-handed twining coil spring 43B1.

First Modified Embodiment

Figure 7:
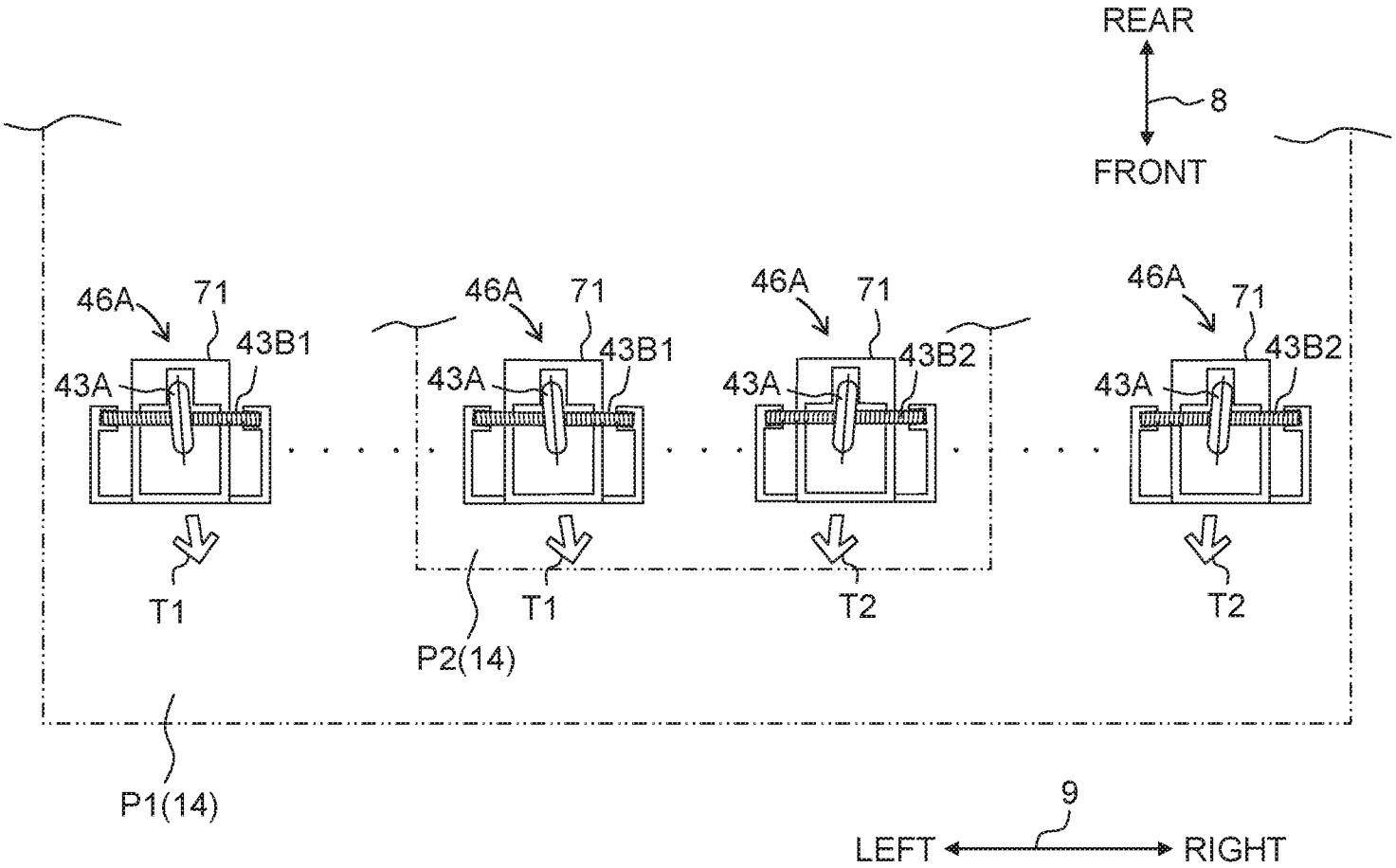
FIG. 7 depicts a plan view illustrating first spurs and spur support portions in a first modified embodiment.

In the embodiment of the present teaching described above, the right-handed twining coil spring 43B1 and the left-handed twining coil spring 43B2 are alternately arranged in the width direction 9. However, there is no limitation to this construction. As depicted in FIG. 7, the following configuration is also appropriate. That is, the twining directions of the two coil springs 43B arranged on the outermost sides in the width direction 9 are different from each other in the area in which the recording paper 14 is conveyed. There is such a tendency that the recording paper 14 skews by being greatly affected by the force exerted from the first spur 43A arranged on the outer side in the width direction 9. Therefore, if the directions, in which the two first spurs 43A arranged on the both outer sides in the width direction 9 are inclined, are identical, the recording paper 14 more easily skews in the direction in which the first spurs 43A are inclined. In the first modified embodiment, the two coil springs 43B disposed on the both outer sides in the width direction 9, which most greatly affect the skew of the recording paper 14, have the different twining directions. Therefore, the two first spurs 43A, which are arranged on the both outer sides in the width direction 9, are easily inclined in the mutually different directions. Accordingly, the forces intended to skew the recording paper 14, which are received by the recording paper 14 from the two first spurs 43A arranged on the both outer sides in the width direction 9, can be counteracted with each other. Therefore, it is possible to effectively suppress the skew of the recording paper 14. Note that the twining directions of the coil springs 43B disposed on the both outer sides in the width direction 9 may be different from each other as in the first modified embodiment, and the twining directions of the two coil springs 43B adjoining with each other in the width direction 9 may be different from each other as in the embodiment described above. According to the configuration provided as described above, it is possible to more effectively suppress the skew of the recording paper 14.

Further, when types of the recording paper 14, which have different lengths in the width direction 9, are conveyed, the twining directions of the coil springs 43B arranged on the both outer sides in the width direction 9 may differ in the areas in the width direction 9 through which the respective types of the recording paper 14 pass. For example, as depicted in FIG. 7, the twining directions of the coil springs 43B arranged on the both outer sides in the width direction 9 differ in the area in which the recording paper P1 having the A4 size is conveyed, and the twining directions of the coil springs 43B arranged on the both outer sides in the width direction 9 differ in the area in which the postcard P2 is conveyed. As described above, the configuration is made such that the two first spurs 43A, which are arranged on the both outer sides in the width direction 9, are easily inclined in the mutually different directions, in relation to the respective types of the recording paper 14. Thus, it is possible to effectively suppress the skew in relation to the respective types of the recording paper 14.

Second Modified Embodiment

Figure 8:
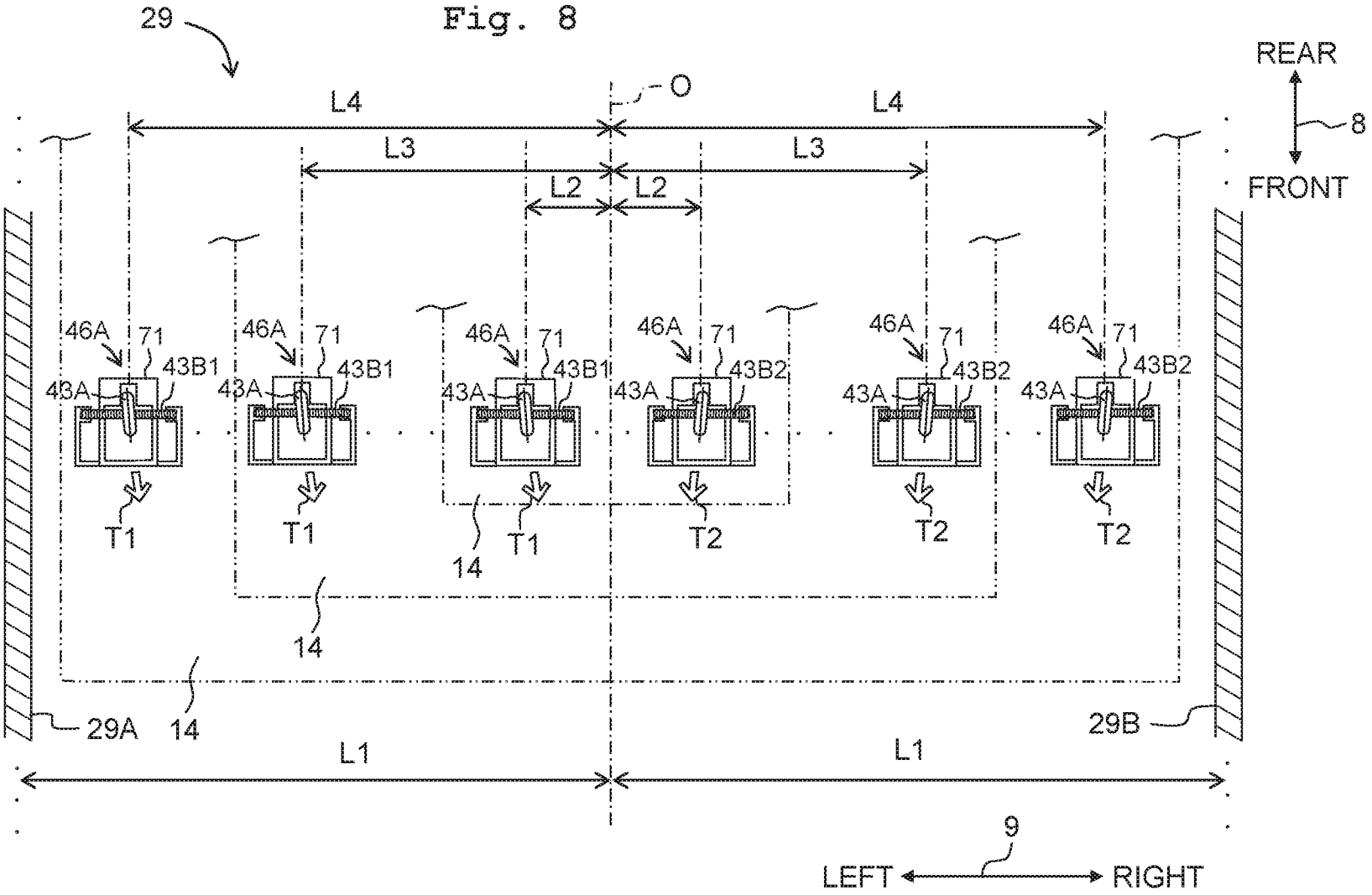
FIG. 8 depicts a plan view illustrating first spurs and spur support portions in a second modified embodiment.

A second modified embodiment will be explained with reference to FIG. 8. In the multifunction peripheral 10 of the embodiment described above, the recording paper 14 is conveyed in the state (center basis) in which the central portion in the width direction 9 moves along the central portion in the width direction 9 of the conveying passage 29. The center basis line O, which is assumed when the recording paper 14 is conveyed on the center basis as described above, is indicated by an alternate long and short dash line in FIG. 8. As depicted in FIG. 8, a guide member 29A is provided at the left end in the width direction 9 of the conveying passage 29, and a guide member 29B is provided at the right end in the width direction 9. The two guide members 29A, 29B are provided to guide the both ends in the width direction 9 of the recording paper 14, and they compart the conveying passage 29. The position of the center basis line O in the width direction 9 is the position which is separated by distances L1 from the two guide members 29A, 29B respectively, i.e., the position which is the center in the width direction 9 between the two guide members 29A, 29B. The position of the center basis line O in the width direction 9 is coincident with the position of the center in the width direction 9 of each of the types of the recording paper 14 conveyed on the center basis in the conveying direction 6.

In the second modified embodiment, the two coil springs 43B, which are supported respectively by the two spur support portions 46A arranged at equal intervals in the width direction 9 from the center basis line O, have different twining directions. For example, as depicted in FIG. 8, the two coil springs 43B, which are supported respectively by the two spur support portions 46A arranged while providing intervals of distances L2 in the width direction 9 from the center basis line O, have different twining directions. In the same manner as described above, the two coil springs 43B, which are supported respectively by the two spur support portions 46A arranged while providing intervals of distances L3 in the width direction 9 from the center basis line O, have different twining directions, and the two coil springs 43B, which are supported respectively by the two spur support portions 46A arranged while providing intervals of distances L4 in the width direction 9 from the center basis line O, have different twining directions. Owing to the configuration as described above, when the recording paper 14 is conveyed on the center basis in the width direction 9, even if the recording paper 14 having any size is conveyed, then the two coil springs 43B, which are arranged on the outermost sides in the width direction 9 of the conveyed recording paper 14, have the different twining directions. Accordingly, it is possible to effectively suppress the skew for each of the types of the recording paper 14 in the same manner as in the first modified embodiment described above.

Third Modified Embodiment

The spur support portion 46A of the third modified embodiment is different from that of the embodiment described above in that the spur support portion 46A is configured to retain the shaft member 43B while inclining the shaft member 43B with respect to the conveying direction 6. A detailed explanation will be made below with reference to FIGS. 9A and 9B.

A first regulating portion 72 of the spur support portion 46A is provided to interpose the shaft member 43B in the conveying direction 6. The first regulating portion 72 has a first regulating surface 72A and a second regulating surface 72B which are opposed to one another. Further, in the same manner as described above, a second regulating portion 73 is also provided to interpose the shaft member 43B in the conveying direction 6. The second regulating portion 73 has a third regulating surface 73A and a fourth regulating surface 73B which are opposed to one another. The four regulating surfaces has a role to regulate the inclination of the shaft member 43B by making abutment against the shaft member 43B in a state in which the first regulating portion 72 and the second regulating portion 73 retain the shaft member 43B.

Figure 9B:
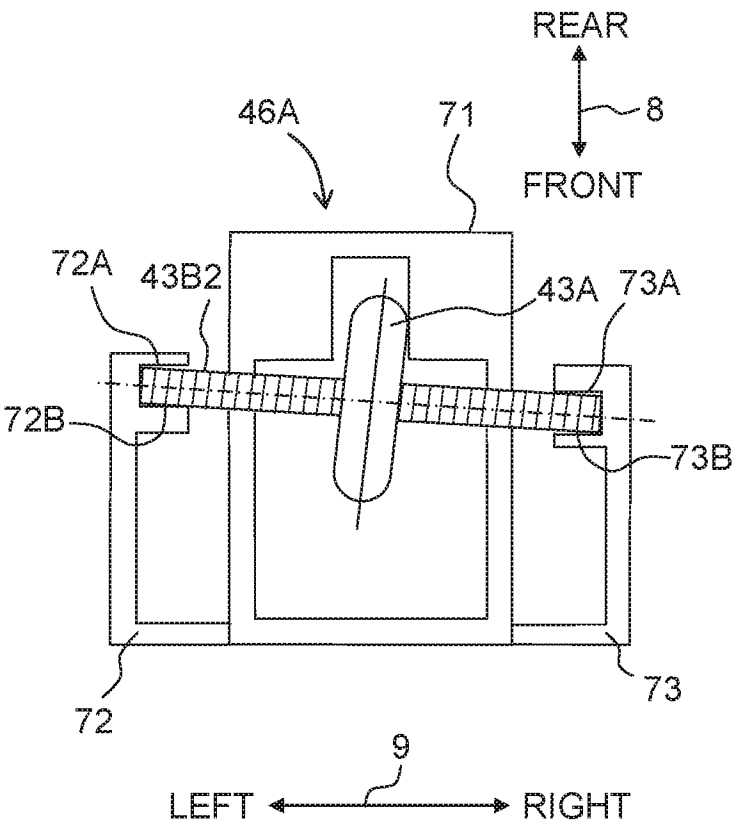
FIGS. 9A and 9B depict plan views illustrating first spurs and spur support portions in a third modified embodiment.
Figure 9A:
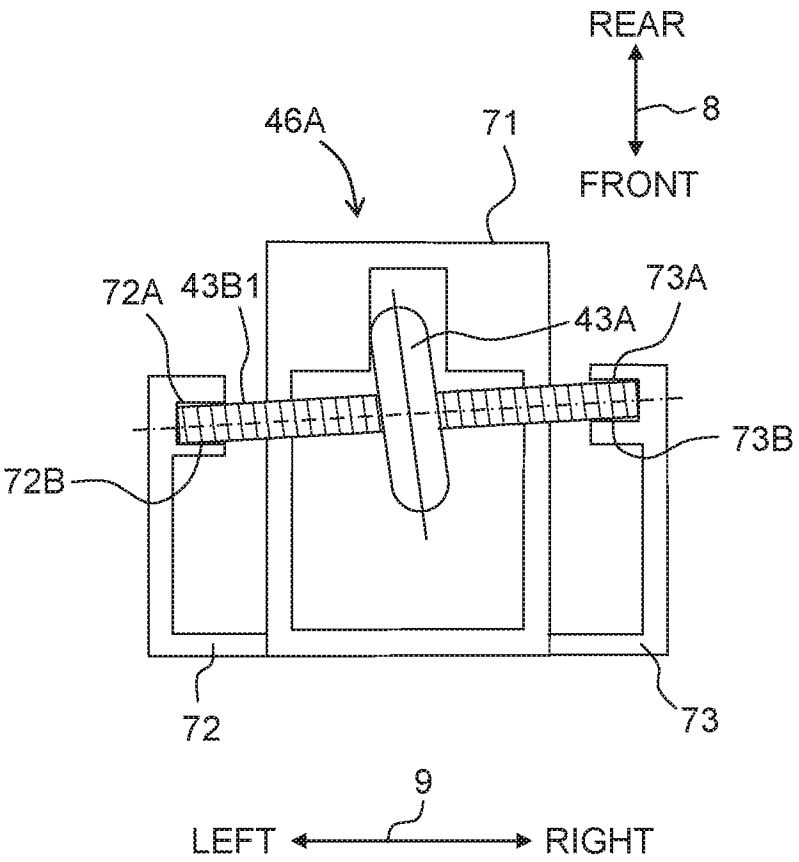

As depicted in FIG. 9A, the first regulating portion 72 and the second regulating portion 73, which retain the coil spring 43B1 having the right-handed twining, are constructed such that the first regulating surface 72A is positioned on the downstream side in the conveying direction 6 as compared with the third regulating surface 73A, and the second regulating surface 72B is positioned on the downstream side in the conveying direction 6 as compared with the fourth regulating surface 73B. On the other hand, as depicted in FIG. 9B, the first regulating portion 72 and the second regulating portion 73, which retain the coil spring 43B2 having the left-handed twining, are constructed such that the first regulating surface 72A is positioned on the upstream side in the conveying direction 6 as compared with the third regulating surface 73A, and the second regulating surface 72B is positioned on the upstream side in the conveying direction 6 as compared with the fourth regulating surface 73B. Accordingly, the coil spring 43B1 having the right-handed twining, which is retained by the first regulating portion 72 and the second regulating portion 73, is retained in a state of being inclined in the direction in which the first spur 43A is easily inclined in accordance with the twining direction of the coil spring 43B1 having the right-handed twining. Further, the coil spring 43B2 having the left-handed twining, which is retained by the first regulating portion 72 and the second regulating portion 73, is retained in a state of being inclined in the direction in which the first spur 43A is easily inclined in accordance with the twining direction of the coil spring 43B2 having the left-handed twining. Note that in FIGS. 9A and 9B, the inclination of the coil spring 43B is expressed greatly for the convenience of explanation.

As described above, the first regulating portion 72 and the second regulating portion 73 are constructed so that the coil spring 43B is inclined in the same direction as the direction in which the first spur 43A is easily inclined. Accordingly, the first spur 43A is more easily inclined in the direction corresponding to the twining direction of the coil spring 43B. Further, the third modified embodiment is illustrative of the example in which the first regulating portion 72 and the second regulating portion 73 are constructed so that the coil spring 43B is inclined in the direction in which the first spur 43A is easily inclined. However, it is also allowable to construct the first regulating portion 72 and the second regulating portion 73 so that the coil spring 43B is inclined in the direction opposite to the direction in which the first spur 43A is easily inclined. In other words, the first regulating portion 72 and the second regulating portion 73, which retain the coil spring 43B1 having the right-handed twining, are configured such that the first regulating surface 72A is positioned upstream in the conveying direction 6 as compared with the third regulating surface 73A, and the second regulating surface 72B is positioned upstream in the conveying direction 6 as compared with the fourth regulating surface 73B. On the other hand, the first regulating portion 72 and the second regulating portion 73, which retain the coil spring 43B2 having the left-handed twining, are configured such that the first regulating surface 72A is positioned downstream in the conveying direction 6 as compared with the third regulating surface 73A, and the second regulating surface 72B is positioned downstream in the conveying direction 6 as compared with the fourth regulating surface 73B. In this case, when the first spur 43A is inclined in the direction corresponding to the twining direction of the coil spring 43B, it is possible to suppress the inclination of the first spur 43A. It is possible to decrease the degree of the skew of the recording paper 14.

Fourth Modified Embodiment

An abutment portion 71 of the spur support portion 46A of the fourth modified embodiment has two first abutment surfaces 71B which can abut against the first spur 43A on the upstream side in the conveying direction 6 from the coil spring 43B and two second abutment surfaces 71C which can abut against the first spur 43A on the downstream side in the conveying direction 6 from the coil spring 43B. Both of the first abutment surfaces 71B and the second abutment surfaces 71C are formed mutually opposed to each other so that the first spur 43A is interposed therebetween in the width direction 9.

Figure 10B:
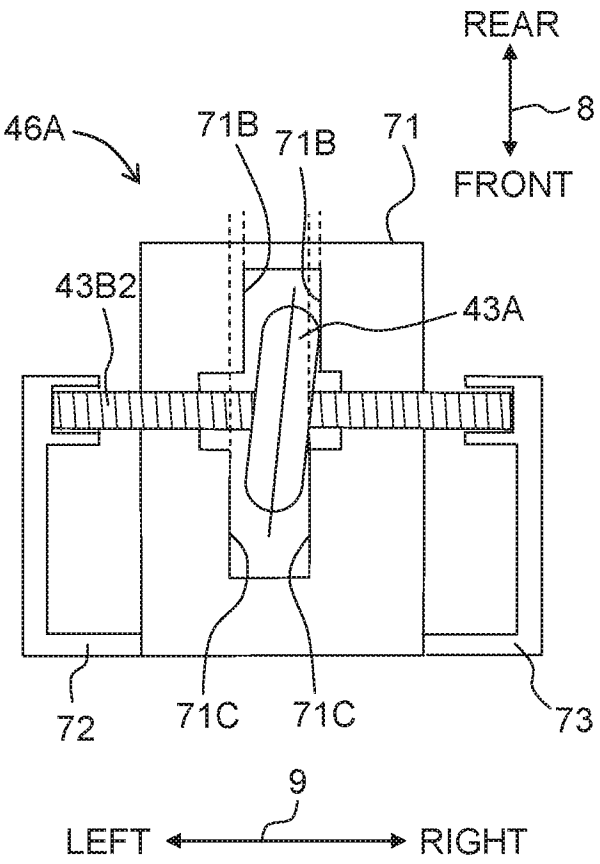
FIGS. 10A and 10B depict plan views illustrating first spurs and spur support portions in a fourth modified embodiment.
Figure 10A:
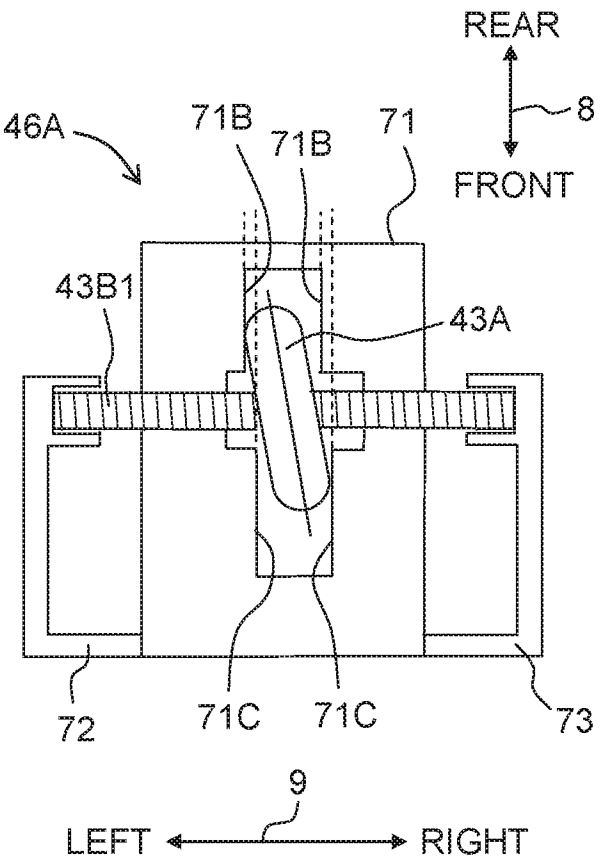

As depicted in FIG. 10A, the spur support portion 46A, which supports the coil spring 43B1 having the right-handed twining, is configured so that the position of the first abutment surface 71B formed on the left side is disposed on the left side as compared with the position of the second abutment surface 71C formed on the left side. Further, the spur support portion 46A is configured so that the position of the first abutment surface 71B formed on the right side is disposed on the left side as compared with the position of the second abutment surface 71C formed on the right side.

On the other hand, as depicted in FIG. 10B, the spur support portion 46A, which supports the coil spring 43B2 having the left-handed twining, is configured so that the position of the first abutment surface 71B formed on the left side is disposed on the right side as compared with the position of the second abutment surface 71C formed on the left side. Further, the spur support portion 46A is configured so that the position of the first abutment surface 71B formed on the right side is disposed on the right side as compared with the position of the second abutment surface 71C formed on the right side.

As described above, the spur support portion 46A of the fourth modified embodiment is configured so that the first spur 43A is regulated from being inclined in the direction opposite to the direction corresponding to the twining direction of the coil spring 43B, and the first spur 43A is easily inclined in the direction corresponding to the twining direction of the coil spring 43B. Accordingly, the first spur 43A is easily inclined more reliably in the direction corresponding to the twining direction of the coil spring 43A. It is possible to more effectively suppress the skew of the recording paper 14.

Effects of Embodiments

In the embodiment described above, the coil springs 43B1 having the right-handed twining direction and the coil springs 43B2 having the left-handed twining direction are used as the shaft members 43B (coil springs) for supporting the first spurs 43A.

In this case, the first spurs 43A can be suppressed from being inclined in any identical direction, and the recording paper 14, which is conveyed in the conveying direction 6, can be suppressed from skewing in the direction in which the first spurs 43A are inclined.

Further, the two coil springs 43B, which are included in the coil springs 43B and which are arranged on the both outer sides in the width direction 9 in the area through which the recording paper 14 passes, have the different twining directions. In another viewpoint, the two coil springs 43B, which adjoin in the width direction 9, have the different twining directions.

In this case, the forces, which are exerted on the recording paper 14 by the respective first spurs 43A and which intend to skew the recording paper 14, can be counteracted with each other among the first spurs 43A. Accordingly, it is possible to more effectively suppress the skew of the recording paper 14.

Further, the first protrusions 43D are provided for any one of the coil spring 43B1 having the right-handed twining and the coil spring 43B2 having the left-handed twining, and the second protrusions 43E, which have the shapes different from those of the first protrusions 43D, are provided for the other. Further, the first engaging portions 72C, 73C, which are engageable with the first protrusions 43D, are provided for the spur support portion 46A for retaining the coil spring 43B having the first protrusions 43D, and the second engaging portions 72D, 73D, which are engageable with the second protrusions 43E, are provided for the spur support portion 46A for retaining the coil spring 43B having the second protrusions 43E.

In this case, it is possible to reduce the fear of assembling the two types of the coil springs 43B having the different twining directions to erroneous positions when the product is assembled, and the product can be easily assembled.

Further, the first regulating portion 72 and the second regulating portion 73 are configured to retain the shaft member 43B in the attitude of being inclined with respect to the conveying direction 6. In this case, the first spur 43A is easily inclined in the direction corresponding to each of the coil springs 43B having the different twining directions. Therefore, it is possible to suppress the skew of the recording paper 14 more effectively.

The recording paper 14 is an example of the sheet of the present teaching. The feed tray 13 is an example of the sheet tray of the present teaching. The conveying passage 29 is an example of the conveying route of the present teaching. The first guide member 29A is an example of the first guide member of the present teaching. The second guide member 29B is an example of the second guide member of the present teaching. The discharge roller 42A is an example of the conveying roller of the present teaching. The first spur 43A is an example of the driven roller of the present teaching. Each of the shaft member 43B, the coil spring 43B1 having the right-handed twining, and the coil spring 43B2 having the left-handed twining is an example of the coil spring of the present teaching. The recording paper P1 having the A4 size is an example of the sheet having the first size of the present teaching. The postcard P2 is an example of the sheet having the second size of the present teaching. The spur support portion 46A is an example of the driven roller holder of the present teaching. The first protrusion 43D is an example of the first protrusion of the present teaching. The second protrusion 43E is an example of the second protrusion of the present teaching. The first engaging portion 72C, 73C is an example of the first engaging portion of the present teaching. The second engaging portion 72D, 73D is an example of the second engaging portion of the present teaching. The first regulating portion 72 is an example of the first regulating portion of the present teaching. The second regulating portion 73 is an example of the second regulating portion of the present teaching. Each of the first regulating surface 72A, the second regulating surface 72B, the third regulating surface 73A, and the fourth regulating surface 73B is an example of the regulating surface of the present teaching. The first abutment surface 71B is an example of the first abutment surface of the present teaching. The second abutment surface 71C is an example of the second abutment surface of the present teaching.

What is claimed is:

1. A sheet conveying apparatus comprising:

a conveying roller configured to convey a sheet in a conveying direction;

driven rollers arranged with intervals in a width direction intersecting with the conveying direction, the driven rollers being opposed to the conveying roller in a direction perpendicular to the conveying direction and the width direction; and coil springs provided corresponding to the driven rollers respectively and serving as rotating shafts for rotatably supporting the driven rollers, wherein the coil springs include a right-handed twining coil spring and a left-handed twining coil spring, and wherein each of the driven rollers is rotatably supported by only one coil spring which is included in the coil springs and which is one of the right-handed twining coil spring and the left-handed twining coil spring.

2. The sheet conveying apparatus according to claim 1, wherein two coil springs, which are included in the coil springs and arranged on outermost sides in the width direction in a sheet-pass area, have different twining directions thereof, the sheet-pass area being an area through which the sheet passes.

3. The sheet conveying apparatus according to claim 1, wherein the sheet conveying apparatus is configured to convey a first sheet having a first size and a second sheet having a second size different from the first size in length along the width direction, first and second coil springs, which are included in the coil springs and arranged on the outermost sides in the width direction in a first sheet-pass area, have different twining directions thereof, the first sheet-pass area being an area through which the first sheet passes, and third and fourth coil springs, which are included in the coil springs and arranged on the outermost sides in the width direction in a second sheet-pass area, have different twining directions thereof, the second sheet-pass area being an area through which the second sheet passes.

4. The sheet conveying apparatus according to claim 1, further comprising:

a sheet tray configured to accommodate the sheet;

a conveying route which is provided downstream of the sheet tray in the conveying direction and through which the sheet is conveyed in the conveying direction; and a first guide member and a second guide member which are provided at both ends in the width direction of the conveying route and which compart the conveying route, wherein the sheet conveying apparatus is configured to convey the sheet so that a central position in the width direction of the sheet is coincident with a central position in the width direction between the first guide member and the second guide member, and two coil springs, which are included in the coil springs and which are arranged at identical intervals from the central position in the width direction between the first guide member and the second guide member, have different twining directions thereof.

5. The sheet conveying apparatus according to claim 1, wherein two coil springs, which are included in the coil springs and which adjoin in the width direction, have different twining directions thereof.

6. A sheet conveying apparatus comprising:

a conveying roller configured to convey a sheet in a conveying direction;

driven rollers arranged with intervals in a width direction intersecting with the conveying direction, the driven rollers being opposed to the conveying roller in a direction perpendicular to the conveying direction and the width direction;

coil springs provided corresponding to the driven rollers respectively and serving as rotating shafts for rotatably supporting the driven rollers; and driven roller holders which are provided corresponding to the driven rollers respectively and which retain the coil springs respectively, wherein the coil springs include a right-handed twining coil spring and a left-handed twining coil spring, wherein one of the right-handed twining coil spring and the left-handed twining coil spring has a first shaft and a first protrusion protruding from an end of the first shaft, and the other of the right-handed twining coil spring and the left-handed twining coil spring has a second shaft and a second protrusion protruding from an end of the second shaft and having a shape different from that of the first protrusion, and a driven roller holder, which is included in the driven roller holders and corresponds to a first one of the coil springs having the first protrusion, has a first engaging portion which is engageable with the first protrusion and which is not engageable with the second protrusion, and another driven roller holder, which is included in the drive roller holders and corresponds to a second one of the coil springs having the second protrusion, has a second engaging portion which is engageable with the second protrusion and which is not engageable with the first protrusion.

7. The sheet conveying apparatus according to claim 6, wherein each of the driven roller holders has a pair of first abutment surfaces and a pair of second abutment surfaces, the first abutment surfaces being provided opposite to each other while interposing, in the width direction, one of the driven rollers corresponding thereto, the first abutment surfaces being provided on an upstream side, in the conveying direction, of one of the coil springs corresponding thereto, the second abutment surfaces being provided opposite to each other while interposing, in the width direction, the one of the driven rollers corresponding thereto, the second abutment surfaces being provided on a downstream side, in the conveying direction, of the one of the coil springs corresponding thereto, the pair of first abutment surfaces are configured to regulate inclination of the one of the driven rollers by abutting against the one of the driven rollers when the one of the driven rollers is inclined with respect to the conveying direction, the pair of second abutment surfaces are configured to regulate inclination of the one of the driven rollers by abutting against the one of the driven rollers when the one of the driven rollers is inclined with respect to the conveying direction, when the downstream side is viewed from the upstream side in the conveying direction, in one of the driven roller holders which retains the right-handed twining coil spring, a first abutment surface, which is included in the pair of first abutment surfaces and is arranged on a right side, is positioned on the right side as compared with a second abutment surface, which is included in the pair of second abutment surfaces and is arranged on the right side, and a first abutment surface, which is included in the pair of first abutment surfaces and is arranged on a left side, is positioned on the right side as compared with a second abutment surface, which is included in the pair of second abutment surfaces and is arranged on the left side, and in another of the driven roller holders which retains the left-handed twining coil spring, the first abutment surface, which is included in the pair of first abutment surfaces and is arranged on the right side, is positioned on the left side as compared with the second abutment surface, which is included in the pair of second abutment surfaces and is arranged on the right side, and the first abutment surface, which is included in the pair of first abutment surfaces and is arranged on the left side, is positioned on the left side as compared with the second abutment surface, which is included in the pair of second abutment surfaces and is arranged on the left side.

8. A sheet conveying apparatus comprising:

a conveying roller configured to convey a sheet in a conveying direction;

driven rollers arranged with intervals in a width direction intersecting with the conveying direction, the driven rollers being opposed to the conveying roller in a direction perpendicular to the conveying direction and the width direction;

coil springs provided corresponding to the driven rollers respectively and serving as rotating shafts for rotatably supporting the driven rollers; and driven roller holders which are provided corresponding to the driven rollers respectively and which retain the coil springs respectively, wherein the coil springs include a right-handed twining coil spring and a left-handed twining coil spring, wherein each of the driven roller holders has a first regulating portion and a second regulating portion which are arranged to oppose each other while interposing, in the width direction, one of the driven rollers corresponding thereto, each of the first regulating portion and the second regulating portion has a pair of regulating surfaces which are provided to interpose, in the conveying direction, one of the coil springs for supporting the one of the driven rollers corresponding thereto, the pair of regulating surfaces being configured to abut against the one of the coil springs and regulate the one of the coil springs from being inclined with respect to the conveying direction, a first regulating surface, which is included in the pair of regulating surfaces of the first regulating portion and disposed on an upstream side in the conveying direction, has a position in the conveying direction different from that of a second regulating surface, which is included in the pair of regulating surfaces of the second regulating portion and disposed on the upstream side in the conveying direction, and a third regulating surface, which is included in the pair of regulating surfaces of the first regulating portion and disposed on a downstream side in the conveying direction, has a position in the conveying direction different from that of a fourth regulating surface, which is included in the pair of regulating surfaces of the second regulating portion and disposed on the downstream side in the conveying direction.

9. The sheet conveying apparatus according to claim 8, wherein when the downstream side is viewed from the upstream side in the conveying direction, the first regulating portion is arranged on a right side of the one of the driven rollers corresponding thereto, and the second regulating portion is arranged on a left side of the one of the driven rollers corresponding thereto, in one of the driven roller holders which retains the right-handed twining coil spring, the first regulating surface disposed on the upstream side in the conveying direction of the first regulating portion is positioned on the downstream side in the conveying direction as compared with the second regulating surface disposed on the upstream side in the conveying direction of the second regulating portion, and the third regulating surface disposed on the downstream side in the conveying direction of the first regulating portion is positioned on the downstream side in the conveying direction as compared with the fourth regulating surface disposed on the downstream side in the conveying direction of the second regulating portion, and in another of the driven roller holders which retains the left-handed twining coil spring, the first regulating surface disposed on the upstream side in the conveying direction of the first regulating portion is positioned on the upstream side in the conveying direction as compared with the second regulating surface disposed on the upstream side in the conveying direction of the second regulating portion, and the third regulating surface disposed on the downstream side in the conveying direction of the first regulating portion is positioned on the upstream side in the conveying direction as compared with the fourth regulating surface disposed on the downstream side in the conveying direction of the second regulating portion.

10. The sheet conveying apparatus according to claim 8, wherein two coil springs, which are included in the coil springs and arranged on outermost sides in the width direction in a sheet-pass area, have different twining directions thereof, the sheet-pass area being an area through which the sheet passes.

11. The sheet conveying apparatus according to claim 8, wherein the sheet conveying apparatus is configured to convey a first sheet having a first size and a second sheet having a second size different from the first size in length along the width direction, first and second coil springs, which are included in the coil springs and arranged on the outermost sides in the width direction in a first sheet-pass area, have different twining directions thereof, the first sheet-pass area being an area through which the first sheet passes, and third and fourth coil springs, which are included in the coil springs and arranged on the outermost sides in the width direction in a second sheet-pass area, have different twining directions thereof, the second sheet-pass area being an area through which the second sheet passes.

12. The sheet conveying apparatus according to claim 8, further comprising:

a sheet tray configured to accommodate the sheet;

a conveying route which is provided downstream of the sheet tray in the conveying direction and through which the sheet is conveyed in the conveying direction; and a first guide member and a second guide member which are provided at both ends in the width direction of the conveying route and which compart the conveying route, wherein the sheet conveying apparatus is configured to convey the sheet so that a central position in the width direction of the sheet is coincident with a central position in the width direction between the first guide member and the second guide member, and two coil springs, which are included in the coil springs and which are arranged at identical intervals from the central position in the width direction between the first guide member and the second guide member, have different twining directions thereof.

13. The sheet conveying apparatus according to claim 8, wherein two coil springs, which are included in the coil springs and which adjoin in the width direction, have different twining directions thereof.

* * * * *